US006990390B2

(12) United States Patent
Groth et al.

(10) Patent No.: US 6,990,390 B2
(45) Date of Patent: Jan. 24, 2006

(54) METHOD AND APPARATUS TO DETECT CHANGE IN WORK TOOL

(75) Inventors: Ronald O. Groth, Metamora, IL (US); Carl A. Kemner, Peoria Heights, IL (US); N. Keith Lay, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/849,102

(22) Filed: May 19, 2004

(65) Prior Publication Data

US 2005/0261799 A1 Nov. 24, 2005

(51) Int. Cl.
*G06F 19/00* (2006.01)

(52) U.S. Cl. ..... 700/180; 700/175; 700/192; 37/413; 37/465

(58) Field of Classification Search ..... 700/17, 700/175, 177, 180, 192, 190, 195, 275, 302; 702/9, 29, 50; 37/386, 189, 450, 453, 451, 37/452, 465, 413
See application file for complete search history.

(56) References Cited

U.S. PATENT DOCUMENTS

| | | | | |
|---|---|---|---|---|
| 5,743,031 | A | 4/1998 | Launder et al. | |
| 5,978,504 | A | 11/1999 | Leger | |
| 6,363,173 | B1 | 3/2002 | Stentz et al. | |
| 2003/0226290 | A1 * | 12/2003 | Savard et al. | 37/348 |
| 2004/0148820 | A1 * | 8/2004 | Horton | 37/411 |
| 2004/0148823 | A1 * | 8/2004 | Schenk | 37/466 |

* cited by examiner

*Primary Examiner*—Leo Picard
*Assistant Examiner*—Chad Rapp

(57) ABSTRACT

Method and apparatus to detect a change in a work tool with an engaging portion. A control system senses a change in the relationship between the engaging portion of the work tool and at least one of the work tool and another engaging portion of the work tool. If the change is greater than a predetermined value, the control system produces an error signal.

34 Claims, 5 Drawing Sheets

METHOD AND APPARATUS TO DETECT CHANGE IN WORK TOOL

TECHNICAL FIELD

This invention relates generally to work machines and work machine implement controls and specifically to a method and apparatus to detect a change in a work tool.

BACKGROUND

Many work machines have work tools with engaging portions that wear or may come unattached in the course of performing their functions. For example, an excavator or a wheel or track type loader may have a bucket with attachable teeth. The teeth may be used to break up dirt or other material when the excavator or loader is digging. In another example, a cold planer may have a rotor with attachable teeth used to break up pavement. In still other examples a landfill or soil compactor may have protrusions on the wheels used to compact trash, an earthmoving machine such as a dozer or backhoe loader may have a ripper with ripper teeth or an agricultural tractor may pull a tillage tool with chisels or other protrusions or attachments.

The engaging portions on work tools may wear or become detached from the work tool such that the work machine is unable to perform its function. If the engaging portions become detached from the work tool other problems may occur on the worksite. For example if bucket teeth from a wheel or track type loader become detached at a quarry site and an unattached tooth goes through a rock crusher, the rock crusher may be damaged and mining operations may cease for a time. If wear or detachment occurs on the protrusions of the rotor on a planer or on the chisels on a soil tillage tool, the work these tools do may become uneven and may need to be repaired.

The operator of a work machine such as an excavator or loader may be able to visually check to ensure that engaging portions of a work tool have not become detached or are not worn such that they can no longer perform their function. This may be done while work is being performed. For example, an operator may visually check a bucket whenever visible from the cab. However, there are periods of time the operator may be unable to see the engaging portions of the work tool to ensure the engaging portions have not detached. In other circumstances environmental factors such as dust may inhibit visibility. On automated work sites where the work machine is automated or operated remotely, it may be impossible for an operator to visually inspect the work tool.

Tools on some work machines may have to be visually inspected at periodic intervals with the machine in a non-working state. For example the rotor on a cold planer may have to be manually inspected at the end of each shift or scythes on a combine may need to be periodically inspected.

U.S. Pat. No. 5,743,031 discloses an apparatus for providing a signal indicative of loss or imminent loss of digging hardware normally arranged in operable association with an earth working implement. However, the apparatus for providing the signal is located on the digging apparatus itself. In some work environments this apparatus may fail. In an autonomous worksite without an operator, the signal may not be seen or recognized.

It would be preferable to have an apparatus and method that overcomes one of these and other disadvantages.

SUMMARY OF THE INVENTION

In one aspect of the present invention an apparatus for detecting a change in a work tool is disclosed. The apparatus includes a work tool having one or more engaging portions for interacting with a work environment, a sensor and a control system. The one or more engaging portions of the work tool have a predetermined relationship with at least one of the work tool and another engaging portion of the work tool. The sensor is adapted to sense the predetermined relationship. The control system is adapted to produce an error signal in response to a change in the predetermined relationship greater than a predetermined value.

In another aspect of the present invention a controller configured to produce an error signal in response to a change in a predetermined relationship of at least one engaging portion of a work tool and at least one of the work tool and another engaging portion of a work tool greater than a predetermined value is disclosed.

In still another aspect of the present invention a method for detecting a change in a work tool is disclosed. The method includes determining an existing predetermined relationship between at least one engaging portions of a work tool and at least one of the work tool and another engaging portion of the work tool; comparing the existing relationship with a desired predetermined relationship of at least one engaging portion of a work tool and at least one of a work tool and another engaging portion of the work tool; and producing an error signal in response to detecting a change in the predetermined relationship between at least one engaging portion of the work tool and at least one of the work tool and another engaging portion of the work tool.

DETAILED DESCRIPTION

Figure 1:
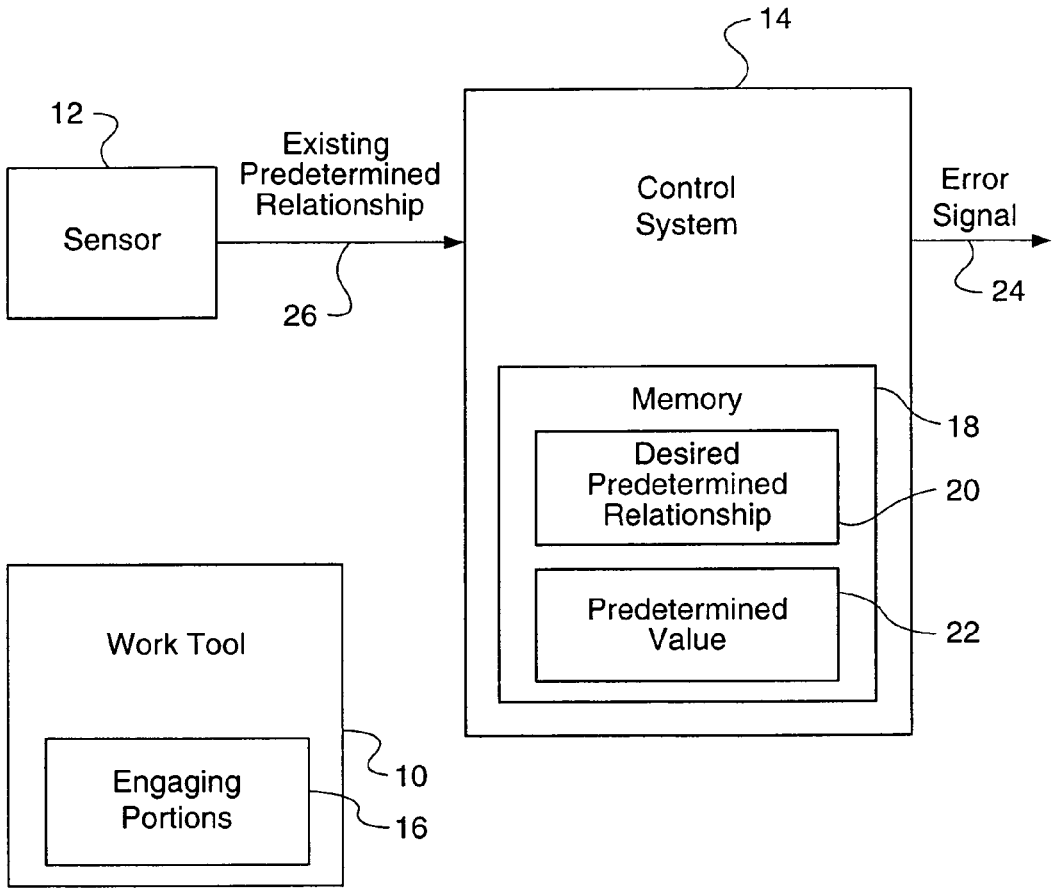
FIG. 1 is a block diagram depicting an apparatus for detecting a change in a work tool.

While the invention is susceptible to various modifications and alternative forms, specific embodiments thereof have been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 6:
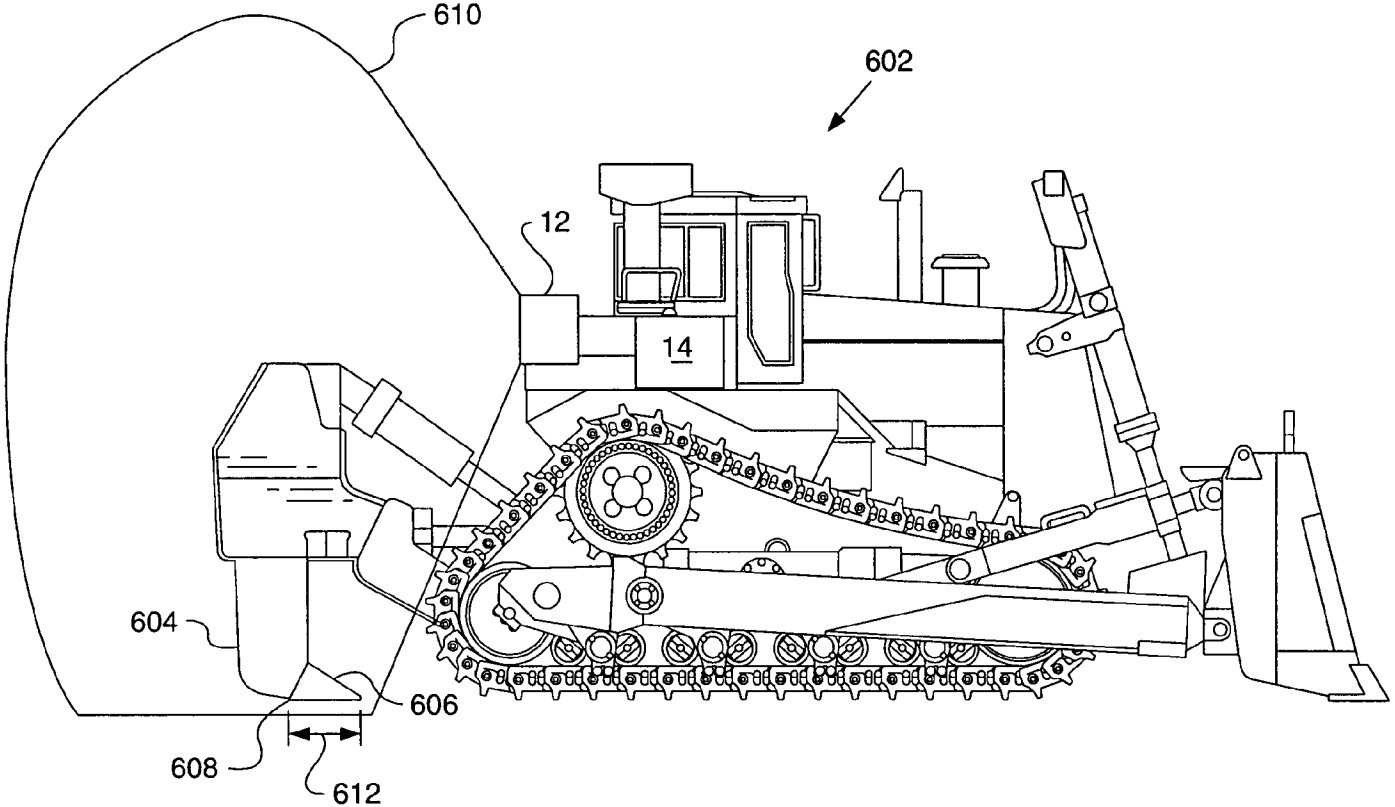
FIG. 6 depicts another embodiment of the invention.

FIG. 1 shows a block diagram of an embodiment of the invention. It includes a work tool 10, a sensor 12 and a control system 14. The work tool 10, sensor 12 and control system 14 may be located on a work machine 302 (FIG. 3), 602 (FIG. 6). The work machine may be a wheel loader, a track-type tractor, an excavator, a cold planer, a track-type dozer, an agricultural machine with a tillage tool, a backhoe loader, a combine, a soil or landfill compactor or any other work machine that could include the work tool 10, sensor 12 and control system 14.

The work tool 10 may be a bucket on an excavator, wheel loader, track-type tractor or backhoe loader. In an alternative embodiment it may be a rotor on a cold planer or a wheel on a landfill or soil compactor. In still other embodiments it may be a sickle on a combine, a tillage tool attached to an agricultural machine or a ripper on a dozer or backhoe loader. The work tool 10 may be an integral part of the work machine or it may be an optional attachment. In some embodiments, it may be pulled by the work machine such as a tillage tool pulled by an agricultural tractor.

The work tool 10 has one or more engaging portions 16 for interacting with a work environment. For example; the work tool 10 may be a bucket 304 (FIG. 4) and may have one or more teeth 306 for digging into dirt, rock or other materials. In other embodiments a rotor may have protrusions for breaking apart pavement, soil or other materials or a wheel on a compactor may have protrusions to compact trash, soil or other materials. In still other embodiments, a tillage tool may have chisels for breaking apart soil, a ripper a tooth for breaking up soil or other materials, or a sickle on a combine may have serrated sections for cutting wheat, soybeans or other crops being harvested.

The one or more engaging portions 16 of the work tool 10 customarily have a predetermined relationship with at least one of the work tool 10 and another engaging portion of the work tool 16. For example, a bucket may have six teeth that protrude a certain distance from the edge of the bucket, or a rotor may have eight rows of twelve protrusions, protruding a certain distance from the surface of the rotor, spaced five inches apart. In other embodiments, a compactor wheel may have ten rows of protrusions, spaced four inches apart, with six protrusions per row spaced five inches apart protruding a certain distance from the wheel surface, or a ripper may have a tooth protruding a certain distance from the ripper edge. In still other embodiments, a sickle on a combine may have multiple sections protruding a certain distance from an edge of the sickle or a tillage tool may have six rows of chisels spaced a certain distance from each other with each chisel protruding a certain distance from the chisel holder.

The sensor 12 is adapted to sense an existing predetermined relationship 26 between one or more engaging portions of the work tool 16 to at least one of the work tool 10 and another engaging portion of the work tool 16 and relay information indicative of the existing predetermined relationship 26 to the control system 14. For example the sensor 12 may sense the distance that each tooth on a bucket protrudes from the bucket edge or it may sense the distance each rotor protrusion protrudes from the surface of the rotor. In alternative embodiments, the distance protrusions on a compactor wheel protrude from the wheel surface or the distance a ripper tooth protrudes from the ripper edge may be sensed. In still other embodiments, the distance a section protrudes from a sickle on a combine or the distance a chisel protrudes from a chisel holder on a tillage tool may be sensed.

The sensor 12 may be a laser scanner such as those produced by Riegl Inc., Optech, Inc. or Schwartz, Inc. In another embodiment the sensor 12 may be a radar scanner. In still other embodiments the sensor 12 may be a charge coupled device (CCD) or an infrared camera.

In an alternative embodiment the invention may include a plurality of sensors 12 that are adapted to sense the predetermined relationship.

The control system 14 has a memory 18 that stores a desired predetermined relationship 20 and a predetermined value 22. The control system 14 is adapted to produce an error signal 24 in response to a change in the predetermined relationship greater than a predetermined value 22. For example, the work tool 10 may be a bucket, the engaging portion 16 of the bucket may be six teeth, and the predetermined relationship may be the distance the teeth protrude from the edge of the bucket. In this embodiment, the control system memory 18 may store the desired predetermined relationship 20 of the six teeth each protruding five inches from the edge of the bucket. In another embodiment, if the work tool 10 is a rotor on a cold planer, the engaging portion 16 of the rotor is eight rows of twelve protrusions, spaced five inches apart and the predetermined relationship is the distance the protrusions protrude, the control system 14 may store the desired relationship 20 of the protrusions all protruding a distance of six inches from the rotor surface. In still another embodiment, if the work tool is a ripper, the engaging portion 16 of the ripper is a ripper tooth and the predetermined relationship is the distance the ripper tooth protrudes from the ripper, the control system 14 may store the desired relationship 20 of the ripper tooth protruding sixteen inches from the ripper. If the work tool 10 is a wheel of a soil or landfill compactor, the engaging portion 16 is ten rows of protrusions, spaced four inches apart, with six protrusions per row spaced five inches apart and the predetermined relationship 20 is the distance the protrusions protrude from the wheel surface, the control system 14 may contain a desired relationship 22 of each protrusion protruding six inches from the wheel surface. Other embodiments of desired predetermined relationships 20 will be obvious to one skilled in the art.

The control system 14 receives from the sensor 12 information indicative of the existing predetermined relationship 26. For example, if the work tool 10 is a bucket, the engaging portion 16 of the bucket is six teeth, and the predetermined relationship is the distance the teeth protrude from the edge of the bucket, if one tooth becomes detached from the bucket and the other five teeth are still attached and unworn, the control system 14 will receive information from the sensor 12 indicative of the existing predetermined relationship 26 of five teeth protruding the desired distance from the bucket edge and one tooth protruding little if any distance from the bucket edge. In another embodiment, the work tool 10 may be a rotor on a cold planer, and the engaging portion 16 of the rotor may be eight rows of twelve protrusions, spaced five inches apart. The predetermined relationship in this example may be the distance the protrusions protrude. If there is no wear on the protrusions, the control system 14 may receive information indicative of the existing predetermined relationship 26 of the protrusions all protruding a distance of six inches from the rotor surface.

In still another embodiment, the work tool 10 may be a ripper and the engaging portion 16 of the ripper may be a ripper tooth. The predetermined relationship may be the distance the ripper tooth protrudes from the ripper and the normal protrusion may be sixteen inches. If the tooth has a broken tip, the control system 14 may receive information indicative of the existing predetermined relationship 26 of the ripper tooth protruding thirteen inches from the ripper.

The work tool 10 may be a wheel of a soil or landfill compactor and the engaging portion 16 may be ten rows of protrusions, spaced four inches apart, with six protrusions per row spaced five inches apart. The predetermined relationship may be the distance the protrusions protrude from the wheel surface. If two protrusions have worn two inches down and the remaining protrusions are worn one inch, the control system 14 may receive information indicative of an existing predetermined relationship 26 of two protrusions protruding four inches from the wheel surface and the remaining protrusions protruding five inches from the wheel surface. Other embodiments of existing predetermined relationships 26 will be obvious to one skilled in the art.

The control system memory 18 stores a predetermined value 22 that is compared to any change in the predetermined relationship. If the change is greater than the predetermined value 22, the control system 14 produces an error signal 24. For example, the work tool 10 may be a bucket and the engaging portion 16 of the bucket may be six teeth. The predetermined relationship may be the distance the teeth protrude from the edge of the bucket. The control system memory 18 may store the predetermined value 22 of one inch. If there is a change of more than one inch in the distance any tooth protrudes from the bucket edge between the desired relationship 22 and the existing relationship, the control system 14 will produce an error signal 24.

In another embodiment the work tool 10 may be a rotor on a cold planer, and the engaging portion 16 of the rotor may be eight rows of twelve protrusions, spaced five inches apart. The predetermined relationship may be the distance the protrusions protrude. The control system memory 18 may store the predetermined value 22 of one half inch. If there is a change of more than one half inch in the distance any protrusion protrudes from the rotor surface between the desired relationship 20 and the existing relationship, the control system 14 will produce an error signal 24.

In still another embodiment, the work tool 10 may be a ripper and the engaging portion 16 of the ripper may be a ripper tooth. The predetermined relationship may be the distance the ripper tooth protrudes from the ripper and the control system memory 18 may store a predetermined value 22 of two inches. If there is a change of more than two inches in the distance the ripper tooth protrudes from the ripper between the desired relationship 22 and the existing relationship, the control system 14 may produce an error signal 24.

If the work tool 10 may be a wheel of a soil or landfill compactor and the engaging portion 16 may be ten rows of protrusions, spaced four inches apart, with six protrusions per row spaced five inches apart. The predetermined relationship may be the distance the protrusions protrude from the wheel surface, and the control system memory 18 may store a predetermined value 22 of one inch. If there is a change of more than one inch in the distance any protrusion protrudes from the wheel surface between the desired relationship 20 and the existing relationship, the control system 14 may produce an error signal 24. The present invention contemplates other predetermined values 22, selectable and known by those having ordinary skill in the art.

The error signal 24 may be used to produce an audible or visible alarm. It may be connected to a visual display for the operator. It may be transmitted to a remote site. The error signal 24 may be used to shut down or in some way alter a machine's operation. The present invention contemplates other ways to process the error signal 24, so as to generate a perceivable indication to the operator which are known to those skilled in the art.

The control system 14 may include one or more controllers (not shown) located in the work machine. Alternatively the control system 14 may include one or more controllers located remotely or a combination of controllers located on the machine and remotely.

In some instances, the work tool 10 may be in a position such that the sensor 12 may not be able to accurately sense the predetermined relationship. For example, a laser scanning sensor may not be able to accurately detect the length of teeth on an excavator bucket if the bucket is currently digging. The control system 14 may be adapted to sense the position of the work tool 10 and the engaging portions of the work tool 16 and determine whether the sensor 12 is able to accurately sense the predetermined relationship. The control system 14 may also be adapted to position the work tool 10 such that the sensor 12 or a plurality of sensors 12 can accurately sense the predetermined relationship For example, if a laser scanning sensor is unable to accurately detect the length of teeth on an excavator bucket as the bucket is currently digging, the control system 14 may be adapted to move the bucket to a position where the laser scanner can accurately detect the length of the teeth.

Figure 2:
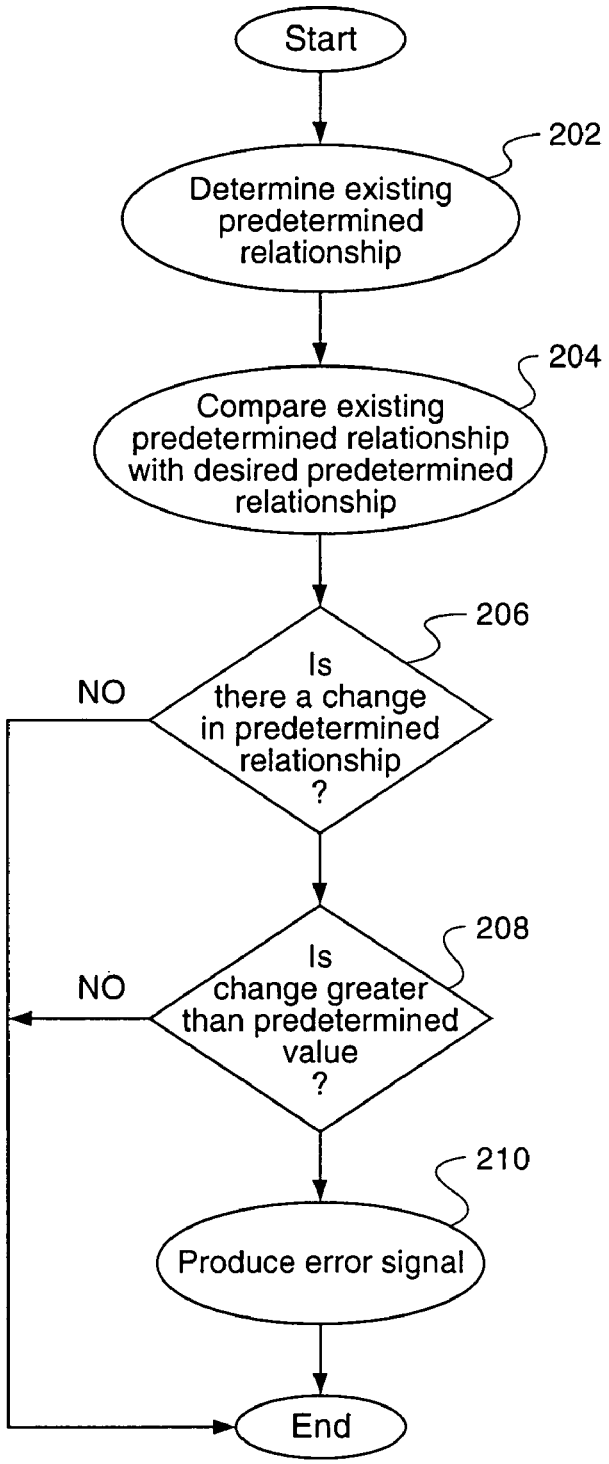
FIG. 2 is a flow chart depicting a method for detecting a change in a work tool.

FIG. 2 is a flow chart depicting an exemplary embodiment of a method for detecting a change in a work tool 10. In block 202, an existing predetermined relationship 26 between at least one engaging portion of a work tool 16 and at least one of the work tool 10 and another engaging portion of the work tool 16 is determined. The sensor 12 senses the existing predetermined relationship 26 and information indicative of the relationship is transmitted to the control system 14.

In block 204, the existing predetermined relationship 26 is compared to a desired predetermined relationship 20 between at least one engaging portion of a work tool 16 and at least one of the work tool 10 and another engaging portion of the work tool 16. The control system 14 has a desired predetermined relationship 20 stored in the control system memory 18 and this is compared to the existing predetermined relationship 26.

In decision block 206 a determination is made whether there has been a change in the predetermined relationship based on the comparison between the existing predetermined relationship 26 and the desired predetermined relationship 20. If there has been a change, control passes to block 208. If there has not been a change, the sequence ends. The control system 14 is adapted to determine whether there is a change between the existing and desired predetermined relationship 20, 26.

In decision block 208, a determination is made as to whether the change in the predetermined relationship is greater than the predetermined value 22. If the change is greater than the predetermined value 22, control passes to block 210. If the change is not greater than the predetermined value 22 control goes to the end of the sequence. The control system 14 is adapted to make this determination.

In block 210, an error signal 24 is produced; which may, for example, be generated by the control system 14 (FIG. 1).

Figure 3:
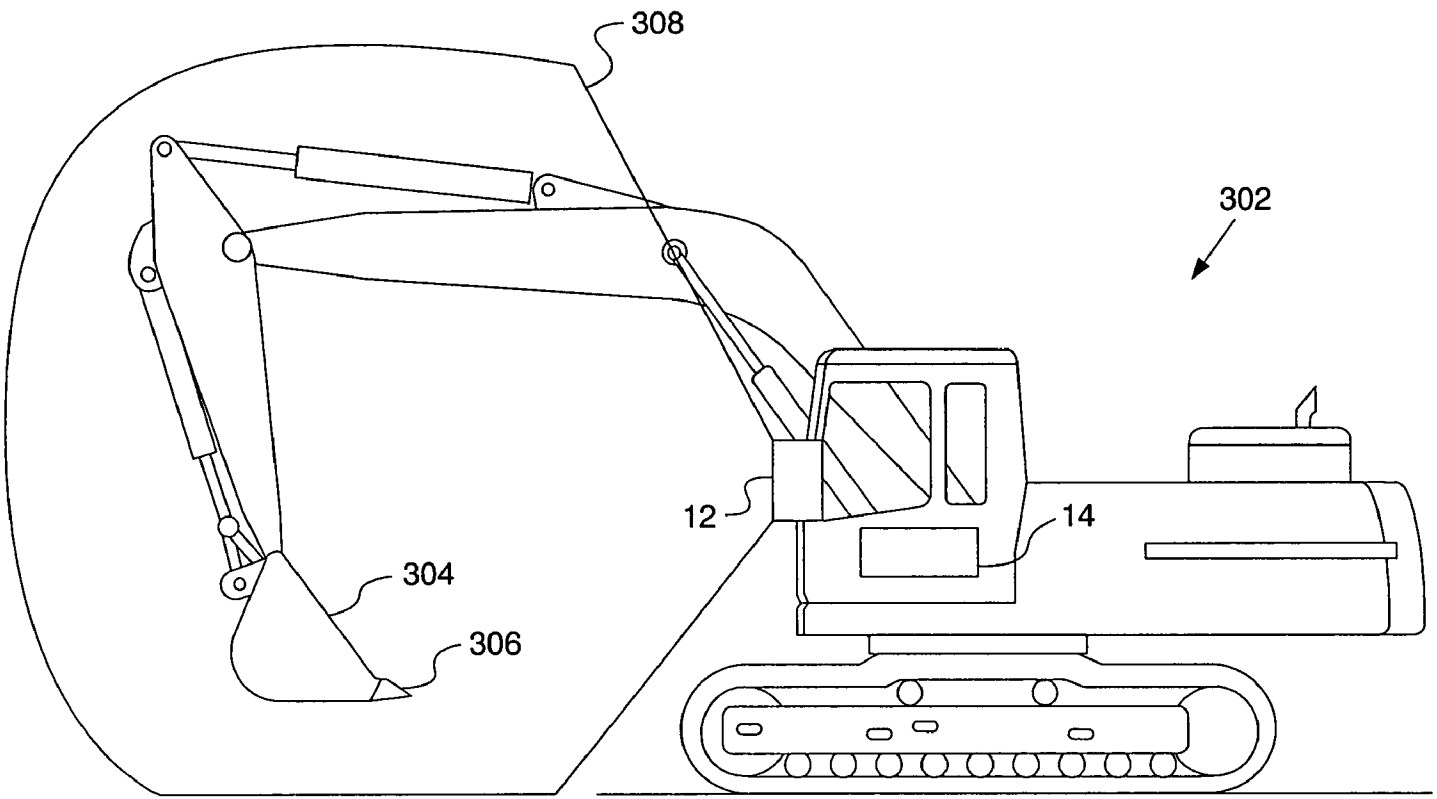
FIG. 3 depicts an embodiment of the invention.

FIG. 3 depicts an embodiment of the invention including an excavator 302 having a bucket 304, a sensor 12 and a control system 14. The bucket 304 may include a plurality of teeth 306.

Figure 4:
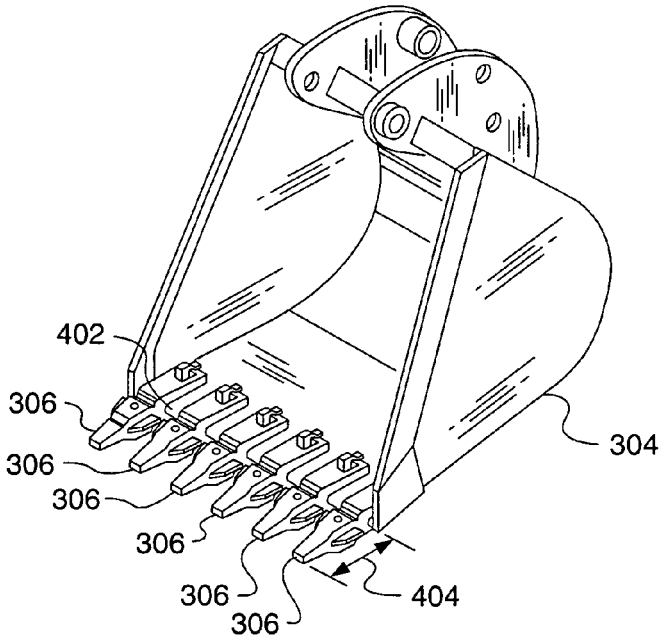
FIG. 4 depicts a work tool with engaging portions.

FIG. 4 depicts the bucket 304 and bucket teeth 306. The bucket 304 includes an edge 402. A predetermined relationship exists between the bucket edge 402 and the end of each bucket tooth 306. In this embodiment the predetermined relationship is the distance 404 between the bucket edge 402 and the end of each bucket tooth 306.

Referring to FIG. 3, in an exemplary embodiment, the sensor 12 may be a laser scanning sensor such as those produced by Riegl Inc., Optech, Inc. or Schwartz, Inc. The sensor 12 may be capable of scanning objects in a defined area 308 and sensing the shape of objects in direct view of the sensor 12, if other objects do not obstruct the direct view.

Figure 5:
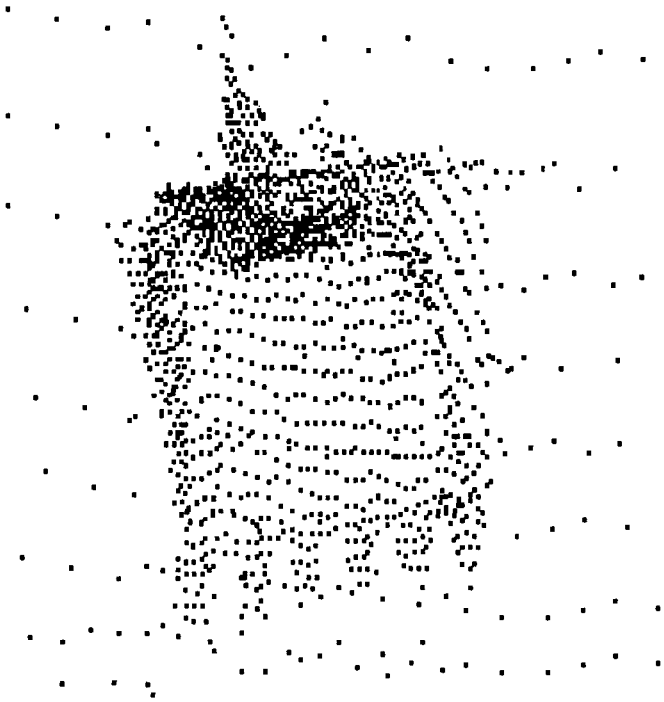
FIG. 5 depicts information from a sensor indicative of a predetermined relationship.

FIG. 5 depicts an electronic display indicative of bucket characteristics generated through the sensor 12 sensing the bucket 304, the bucket teeth 306 and the distance between the edge of the bucket and the end of each bucket tooth 404.

Referring to FIG. 3, the control system 14 is adapted to determine the position of the bucket 304, including the bucket teeth 306. The control system 14 may determine the position of the bucket 304, including the bucket teeth 306, through sensors that sense the position of hydraulic cylinders that move the work tool 10 (not shown) and the geometry of the excavator 302. This method is well known to those of ordinary skill in the art. Other methods of sensing the position of the bucket 304, which are contemplated by the present invention, are those known by those of ordinary skill in the art.

The control system 14 is adapted to determine if the bucket 304 is in the defined area 308 and if the sensor 12 has a view of the bucket 304 such that it can sense the distance 404 between the bucket edge 402 and the end of each tooth 306. The control system 14 may be adapted to move the bucket 304 to a position in the defined area 308 such that the sensor 12 may sense the distance 404 between the edge of the bucket 402 and the end of each tooth 306.

The control system 14 may include a memory 18 that stores a desired distance between the edge of the bucket 402 and the end of each tooth 306. For example, this desired distance may be the distance between the edge of the bucket 402 and the end of each tooth 306 when a tooth 306 is first attached to the bucket 304.

The control system 14 may be adapted to receive information from the sensor 12 indicative of the existing distance 404 between the edge of the bucket 402 and the end of each tooth 306. Further, the control system 14 may be adapted to compare the desired distance between the edge of the bucket 402 and the end of each tooth 306 with the existing distance 404 between the edge of the bucket 402 and the end of each tooth 306, and determine the difference for each tooth 306.

The control system memory 18 may store an acceptable tooth length difference as a predetermined value 22. The control system 14 may be adapted to compare the difference between the desired distance between the edge of the bucket 402 and the end of a tooth 306 and the existing distance 404 between the edge of the bucket 402 and the end of a tooth 306 with the accepted tooth length difference for each tooth 306. If the difference between the desired distance between the edge of the bucket 402 and the end of a tooth 306 and the existing distance 404 between the edge of the bucket 402 and the end of a tooth 306 is greater than the accepted tooth length difference, the control system 14 may produce an error signal 24.

The excavator 302 may have an operator display that displays a warning in response to the error signal 24. In another embodiment the excavator 302 may have an audible alarm that sounds in response to the error signal 24. In still another embodiment the excavator 302 may have a control system 14 that sends the error signal 24 to a remote location. Other responses contemplated by the present invention to the error signal 24 will be obvious to those of ordinary skill in the art.

FIG. 6 depicts another embodiment of the invention. This embodiment includes a track-type tractor 602. The track-type tractor 602 may include a ripper 604, a sensor 12 and a control system 14. The ripper 604 may include a ripper tooth 606 and a ripper edge 608.

The sensor 12 may be a radar scanning sensor. The sensor 12 may be capable of scanning objects in a defined area 610 and detecting the shape of the objects.

The control system 14 may determine the position of the ripper 604, including the ripper tooth 606 and ripper edge 608. The control system 14 may sense the position of the ripper 604, including the ripper tooth 606 and ripper edge 608, through sensors that sense the position of hydraulic cylinders that move the ripper (not shown) and the geometry of the track-type tractor. This method is well known to those of ordinary skill in the art. Other methods of sensing the position of the ripper 604 which are contemplated by the present invention are those known by those in the art.

The control system 14 may determine if the ripper 604 is in the defined area 610 such that the sensor 12 may sense the distance 612 between the ripper edge and the end of the ripper tooth 612. The control system 14 may move the ripper 604 to a position in the defined area 610 in which the sensor 12 can sense the distance 612 between the edge of the ripper 608 and the end of the ripper tooth 606.

The control system 14 may also include a memory 18 that stores a desired distance between the edge of the ripper 608 and the end of the ripper tooth 606. This desired distance may be the distance between the edge of the ripper 608 and the end of the ripper tooth 606 when the tooth 606 was first attached to the ripper 604.

The control system 14 may receive information from the sensor 12 indicative of the existing distance 612 between the edge of the ripper 608 and the end of the ripper tooth 606. The control system 14 may compare the desired distance between the edge of the ripper 608 and the end of the ripper tooth 606 with the existing distance 612 between the edge of the ripper 608 and the end of the ripper tooth 606 and determine the difference.

The control system memory 18 may store an accepted tooth length difference as a predetermined value 22. The control system 14 may compare the difference between the desired distance between the edge of the ripper 608 and the end of the ripper tooth 606 and the existing distance 612 between the edge of the ripper 608 and the end of the ripper tooth 606 with the accepted tooth length difference 22. If the difference between the desired distance between the edge of the ripper 608 and the end of the ripper tooth 606 and the existing distance 612 between the edge of the ripper 608 and the end of the ripper tooth 606 is greater than the accepted tooth length difference 22, the control system 14 may produce an error signal 24.

The track-type tractor 602 may have a operator display that displays a warning in response to the error signal 24. In another embodiment the loader may have an audible alarm that sounds in response to the error signal 24. In still another embodiment the loader may have a control system 14 that sends the error signal 24 to a remote location. Other responses to the error signal 24 which are contemplated by the invention will be known to those of ordinary skill in the art.

INDUSTRIAL APPLICABILITY

The present invention provides an apparatus and method for detecting a change in a work tool 10. A work machine 302 (FIG. 3), 602 (FIG. 6) on a work site may have a work tool 10, 304 (FIG. 3), 604 (FIG. 6) with ground engaging portions 306 (FIG. 3), 606 (FIG. 6) that may wear or become detached from the work tool 10, 304 (FIG. 3), 604 (FIG. 6). When the ground engaging portions of the work tool 306 (FIG. 3), 606 (FIG. 6) wear or become detached, the work may not be done correctly and may have to be repeated. Additional damage may be done and time wasted when a ground engaging portion such as a tooth 306 (FIG. 3) on an excavator bucket 304 (FIG. 3) becomes detached and damages other equipment on the work site. For example, a detached excavator bucket tooth 306 (FIG. 3) may damage a rock crusher at a quarry.

The apparatus senses an existing predetermined relationship 26 such as the distance from the edge of an excavator bucket to the end of the bucket tooth 404 (FIG. 4) and compares this to a desired predetermined relationship 20. The apparatus produces an error signal 24 if the difference between the existing predetermined relationship 26 and the desired predetermined relationship 20 is greater than a predetermined value 22. The error signal 24 may activate various alarms or displays to inform the operator that a work tool 10 has changed.

Other aspects, objects and features of the present invention can be obtained from a study of the drawings, the disclosure and the appended claims.

What is claimed is:

1. An apparatus to detect a change in a work tool, comprising:

a work tool having one or more engaging portions wherein at least one of the engaging portions defines a predetermined positional relationship with at least one of the work tool and another engaging portion of the work tool;

a sensor adapted to generate a signal indicative of an image of the work tool, the image including the predetermined positional relationship; and an electronic controller including a memory element, the memory element including a desired magnitude and a predetermined value, the controller adapted to receive the signal indicative of an image of the work tool, determine a magnitude of the predetermined positional relationship as a function of the image, determine a difference between the magnitude and the desired magnitude, and produce an error signal in response to the difference exceeding the predetermined value.

2. The system of claim 1 wherein the sensor is a laser sensor.

3. The system of claim 1 wherein the sensor is a radar sensor.

4. The systems of claim 1 wherein the sensor is a charge coupled device.

5. The system of claim 1 wherein the sensor is an infrared camera.

6. The system of claim 1 wherein the work tool is a bucket on a work machine.

7. The system of claim 1 wherein the work tool is a rotor on a work machine.

8. The system of claim 1 wherein the work tool is a ripper on a work machine.

9. The system of claim 6 wherein the one or more engaging portions are digging hardware attached to the bucket.

10. The system of claim 7 wherein the one or more engaging portions are protrusions on a rotor.

11. The system of claim 8 wherein the one or more engaging portions is a ripper tooth.

12. The system of claim 1 wherein the controller is located on a work machine.

13. The system of claim 1 further comprising:

an operator display operable to display information indicative of the predetermined relationship to a work machine operator.

14. The system of claim 1 further comprising:

an audible alarm that is activated when the error signal is produced by the controller.

15. The system of claim 12 wherein the controller is operable to disable the work machine in response to the error signal being produced.

16. A controller, including a memory element, the memory element including a desired magnitude and a predetermined value, configured to receive a signal indicative of an image of a work tool including a predetermined positional relationship of at least one engaging portion of the work tool to at least one of the work tool and another engaging portion of the work tool, determine a magnitude of the predetermined positional relationship as a function of the image, determine the difference between the magnitude and the desired magnitude, and produce an error signal in response to the difference exceeding a predetermined value.

17. The controller of claim 16 wherein the work tool is a bucket on a work machine.

18. The controller of claim 16 wherein the work tool is a rotor on a work machine.

19. The controller of claim 16 wherein the work tool is a ripper on a work machine.

20. The controller of claim 17 wherein the at least one engaging portion is digging hardware attached to the bucket.

21. The controller of claim 18 wherein the at least one engaging portion is a protrusion on a rotor.

22. The controller of claim 19 wherein the at least one engaging portion is a ripper tooth.

23. The controller of claim 16 wherein the controller is located on a work machine.

24. The controller of claim 23 wherein the controller is configured to operate an operator display displaying information indicative of the predetermined relationship to a work machine operator.

25. The controller of claim 16 wherein the controller is configured to activate an audible alarm when the error signal is produced.

26. The controller of claim 23 wherein the controller is operable to disable the work machine in response to the error signal being produced.

27. A method for detecting a physical change in a work tool having one or more engaging portions wherein at least one of the engaging portions defines a predetermined positional relationship with at least one of the work tool and another engaging portion of the work tool, comprising:

generating an electronic signal indicative of an image of the work tool including the predetermined positional relationship;

determining the magnitude of the predetermined positional relationship as a function of the image;

comparing the magnitude of the predetermined positional relationship with a desired magnitude;

determining a difference between the magnitude of the predetermined positional relationship and the desired magnitude; and producing an error signal in response to the difference exceeding a predetermined value.

28. The method of claim 27 further comprising:

producing an audible signal in response to the error signal being produced.

29. The method of claim 27 further comprising:

displaying the magnitude of the predetermined positional relationship to an operator of a work machine.

30. The method of claim 27 further comprising:

displaying the desired magnitude to an operator of a work machine.

31. The method of claim 27 further comprising:

disabling a work machine in response to the error signal.

32. The apparatus of claim 1, wherein the memory element includes a control image of the work tool and the magnitude of the predetermined positional relationship is determined by comparing the image indicated by the signal and the control image.

33. The controller of claim 16, wherein the memory element includes a control image of the work tool and the magnitude of the predetermined positional relationship is determined by comparing the image indicated by the signal and the control image.

34. The method of claim 27 wherein determining the magnitude of the predetermined positional relationship includes comparing the image indicated by the signal with a control image.

* * * * *